United States Patent [19]

Kireta

[11] Patent Number: 5,056,747

[45] Date of Patent: Oct. 15, 1991

[54] BIASABLE BRACKET DEVICE FOR MOUNTING A DECORATIVE LIGHT IN MULTIPLE LOCATIONS

[76] Inventor: Andrew G. Kireta, 504 Whooper Way, Suisun, Calif. 94585

[21] Appl. No.: 556,105

[22] Filed: Jul. 20, 1990

[51] Int. Cl.[5] ..... A47B 96.06

[52] U.S. Cl. ..... 248/231.8; 211/26; 248/74.2

[58] Field of Search ..... 248/231.8, 68.1, 74.2, 248/74.3, 316.7, 224.3, 74.4, 74.5, 71, 909; 211/26; 24/336, 543, 601.8

[56] References Cited

U.S. PATENT DOCUMENTS

| | | | |
|---|---|---|---|
| 2,216,876 | 10/1940 | Crum | 248/74.2 |
| 3,019,954 | 2/1962 | Faltin | 248/316.7 X |
| 3,181,827 | 5/1965 | Sassin | 248/74.2 |
| 3,193,229 | 7/1965 | Stock | 248/74.2 |
| 3,275,818 | 9/1966 | Campbell | 24/336 |
| 3,438,604 | 4/1969 | Spicer | 248/74.5 |
| 3,599,916 | 8/1971 | Szabo | 248/231.8 X |
| 3,599,918 | 8/1971 | Patchett | 248/231.8 X |
| 3,861,632 | 1/1975 | Siilats | 248/224.3 |
| 4,397,438 | 8/1983 | Champman | 248/231.8 X |
| 4,527,759 | 7/1985 | Dorner et al. | 248/68.1 X |

FOREIGN PATENT DOCUMENTS

| | | | |
|---|---|---|---|
| 2429349 | 1/1980 | France | 248/231.8 |

*Primary Examiner*—David L. Talbott

*Assistant Examiner*—Daniel Hulseberg

*Attorney, Agent, or Firm*—Harold D. Messner

[57] ABSTRACT

A biasable bracket device useful in installing, displaying and easily removing decorative lights is described that can be installed in multiple locations about a building. The invention comprises: (i) an inverted Cee-shaped segment including first, second and third legs. The third leg forms a central support, with the first and sceond legs extending in the same direction, cantilever style, therefrom and their free ends biased inwardly toward each other; (ii) a Vee-shaped fourth leg also cantilevered from the third leg between the first and second legs. The attached end of the fourth leg is more rigid and its free end folds back adjacent to the broad surface of the second leg to provide a passageway that can be biased open to fixedly receive a shingle or roof ridge or to receive a lip of a deep cupped rain gutter to define a first working position. The attached end of the Vee leg also defines a second opening with repect to the first leg that can be biased in an outward direction receive a rafter, facia board or rail of rectangular cross section thereby defining a second working position whereby flexiblity of operation to capture and display the string of lights is attained. An article of manufacture is also described in which a tab is added to the upper leg of the bracket device during manufacture. Once detached, such tabs can used as light supports aobut windows, doors and the like.

13 Claims, 3 Drawing Sheets

BIASABLE BRACKET DEVICE FOR MOUNTING A DECORATIVE LIGHT IN MULTIPLE LOCATIONS

SCOPE OF THE INVENTION

This invention relates to devices for installing and displaying decorative lights around a house, business or the like and more particularly to a biasable bracket device for a decorative light that can be located in multiple locations in and about such environments and in accordance with one aspect, without the need for attachment tools or attaching means such as screws, nails or other hardware.

BACKGROUND OF THE INVENTION

The use of exterior decorative lighting on residences and businesses has increased in recent times. The lights are usually manufactured in strings in which a plurality of sockets are wired together using electrical leads projecting at right angles across the base of the socket. Colored bulbs are inserted into the sockets. Plugs at the ends of the electrical leads are also provided for connection to other strings and eventually to a power source.

Since the use of such lighting strings are seasonal, such lights are usually installed at the start of the season and removed toward the end. Various methods and brackets have been proposed in installing the light strings. In this regard, staple guns have been employed at the eaves and roof ridge of buildings to attach the light strings.

Nails and threaded hooks have also been used. Such devices add to the difficulty of installation and leave holes or parts of the staples, nails, etc, on the buildings after the lights have been removed. See for example, U.S. Pat. No. 3,189,710 (Trueson).

In addition, brackets have been proposed for use between shingles (U.S. Pat. No. 4,851,977 (Gary) and references there cited. Furthermore, clamps have also been constructed for attachment to gutters and the like, see U.S. Pat. No. 3,861,632 (Siilats). However, there remains a need for an integral bracket for decorative lights that can be attached to not only eave and ridge shingles, but also to wooden rafters below eaves, facia boards, rain gutters, and wooden horizontal supports of yard fences and rails surrounding such buildings.

SUMMARY OF THE INVENTION

According to the present invention, a biasable bracket device useful in installing, displaying and easily removing decorative lights is described that can be installed in multiple locations about a building. The locations for the invention includes shingles of roof eaves and roof ridges, roof rafters and facia boards of rectangular cross section, supports of rectangular cross section for fences, patios and the like, rain gutters and moldings around windows and doors. In one form, the invention comprises:

(i) an inverted Cee-shaped segment including first, second and third legs of rectangular cross section. The third leg forms the central support of the Cee-shaped segment. The first and second legs extend in the same direction, cantilever style, from the third leg, and their free ends biased inwardly toward each other;

(ii) a Vee-shaped fourth leg also cantilevered from the third leg between the first and second legs. The attached end of Vee fourth leg is more rigid than the first and second legs, however. Its free end folds back adjacent to the broad surface of the second leg to provide a passageway that can be biased open to fixedly receive a shingle of an eave shingle or roof ridge or to receive a lip of a deep cupped rain gutter to define a first working position. On an opposite side, the attached end of the Vee leg defines a second opening with respect to the first leg that can biasing in an outward direction receive a rafter, facia board or rail of rectangular cross section thereby to define a second working position.

Note that the orientation of the first and second working positions are variable with respect to each other, depending upon the application. In the first working position, the bracket device is disconnectably connected to the roof both below and above the surface of the roof shingle. Thus the first (upper) leg of the bracket device extends above the roof by a distance equal to the height of the third leg minus the height of the Vee-leg above the second (lower) leg. But when used in association with deep cupped rain gutter, the bracket device disconnectably connects to the remote lip of the gutter. In both these applications, the legs define a common vertical plane. But in the second working position, the legs can be defined by either a horizontal, vertical or off-vertical plane. That is to say, at the end of a roof rafter, for example, the legs define a common horizontal plane. But when attached to the bottom of a facia board, the legs of the bracket device can be in a vertical plane or if the facia board angles toward the roof ridge, can be in off vertical plane define by the angle of the roof. For fence and patio rails that are horizontal, the bracket device of the invention is used wherein the legs lie in a vertical plane with the second opening, of course, being used to capture the fence rail. In any of the above-described working positions, a plurality of clips extend outward from and across the broad surfaces of the first and third legs. The clips are oriented in different directions to receive and disconnectably capture the electrical conductors of the string of lights in a variety of directions. Each opening defined by each clip can be biased inwardly toward the surface of the legs as the clip base is approached to capture the electrical conductors (and hence the light string) in a multiplicity of orientations.

DESCRIPTION OF A DETAILED EMBODIMENT

Figure 1:
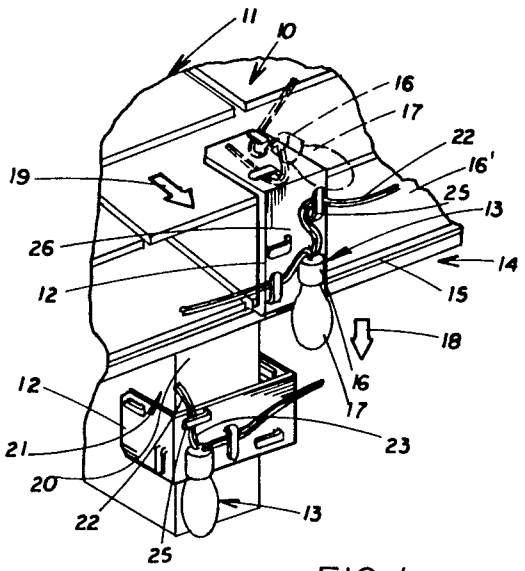
FIG. 1 is a perspective view of a shingled roof of a house showing a plurality of bracket clamping devices of the invention in a variety of locations to receive and display decorative strings of lights, viz., at the roof eaves including locations at the roof edge beneath a shingle and at eave roof rafter.

FIG. 1 is a perspective view of a shingled roof 10 of a house 11 showing a pair of bracket clamping devices 12. The purpose of the clamping devices 12 of the present invention: to support and display decorative string of lights 13 in three separate locations along roof eaves 14, and then allow their easy removal along with devices 12 without tools. The strings of lights 13 are supported at two locations along roof edge 15. As shown, the device 12 is oriented in a first working position by sliding a part of the device 12 beneath one of shingle 16. In such a working position, a portion of the string of the lights 13 is attached in two orientations: (i) a position in which light socket 16 and bulb 17 hangs in a downward direction, say along arrow 18, and (ii) in a second position wherein the socket 16 and bulb 17 extend in a more horizontal direction, say along arrow 19. Such positions are shown in solid and phantom line, respectively, in FIG. 1. In addition, the device 12 can also be located in a second working positin, say at an end 20 of a roof rafter 21 using another part of the bracket device 12, as explained in more detail below.

Note that in both working positions, the bracket device 12 is attached to the roof 10 of the house 11 by biasing pressure alone. Hence need for attaching tools such as hammers, screw drivers and the like as well as associated attaching means such as nails, threaded fasteners, gutters, magnets or the like, are not needed. Removal for similar reasons, is expedited.

The string of lights 13 are usually manufactured in strings in which a number of sockets 16 are wired together using electrical conductors 22 projecting at right angles across base 23 of each socket 16. That is, the conductors 22 pass across the base 23 of each socket 16 in a direction that is normal to the axis of symmetry of the bulb 17. The bulbs 17 are usually provided with a covering of colored glass. Plugs (not shown) at the ends of the electrical conductors 22 are also provided for connection to other strings and eventually to a power source. As shown, the string of lights 13 is captured in clips 25 of the bracket clamping devices 12 of the present invention. The electrical conductors 22 are positioned within the opening between each clip 25 and broad surfaces 26 of each device 12.

Figure 9:
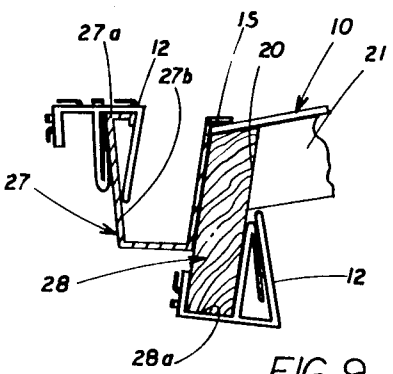
FIG. 9 is a section taken along line 9—9 of FIG. 8.
Figure 8:
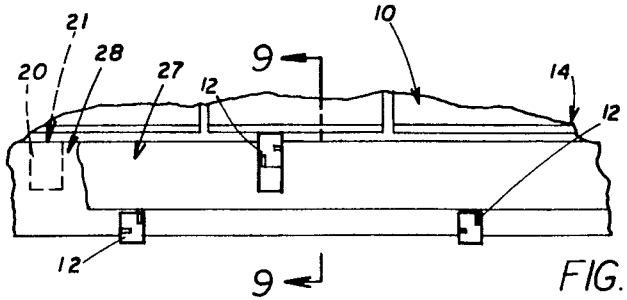
FIG. 8 is a front elevation of the house of FIG. 1 showing a deep cupped rain gutter attached to both the roof and a facia board that, in turn, is attached at the ends of the roof rafters below the eaves wherein a trio of the bracket devices of the invention are seen to be disconnectably connected to the lip of the rain gutter and the facia board, respectively.

The home owner or businessman can position the string of lights 13 in many other locations using the bracket clamping device 12 of the present invention. For example, as shown in FIGS. 8 and 9, a trio of the bracket devices 12 of the invention, are shown positioned along roof eaves 14 in attachment in two different applications: (1) to a deep cupped rain gutter 27 attached to the roof 10 and (2) to a facia board 28 that, in turn, is attached at the ends 20 of the roof rafters 21 below the eaves 14. With regard to item (1), above, the bracket device 12 is attached to the remote lip **27*a* of the gutter 27 most remote of edge 15, see FIG. 9. In this application, a part of the device 12 previously located below the shingle of the roof, is slid about the more vertical sides 27*b* of the gutter. With regard to item (2), above, the bracket device 12 is attached to the bottom end 28*a* of the facia board 28** using the bracket device in the second working position, as also explained in more detail below.

In the application shown in FIGS. 8 and 9, the lights 13 have been omitted for the sake of clarity but would be positioned along the bracket devices 12 in a horizontal fashion. Still other locations for the lights 13 are possible, say near portions of the ridge of the roof 10 (not shown) of the house 11. Or the lights 13 can be located along horizontal rails of rectangular cross section used to construct fences, side rails of patios and the like about the house 11.

Figure 2:
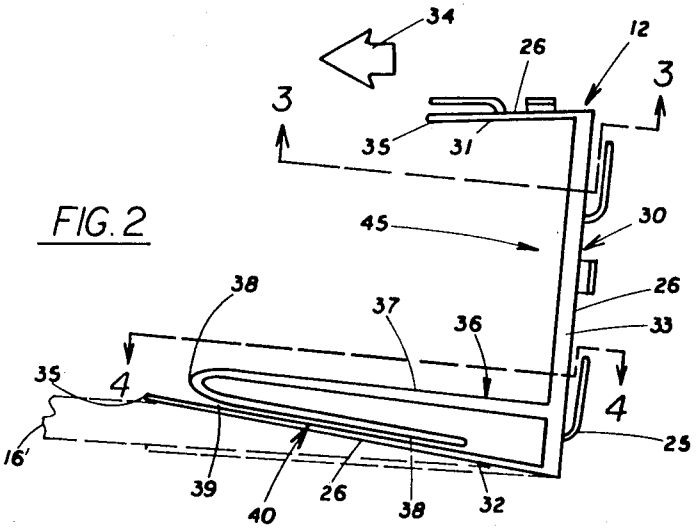
FIG. 2 is a side elevation of the bracket clamping device of the invention showing in phantom line how the cantilevered lower leg of the inverted Cee-shaped segment can be opened to receive a roof shingle between it and a more rigid Vee-shaped fourth leg also cantilevered from the support leg of the Cee-shaped segment.

FIG. 2 shows the bracket clamping device 12 in more detail.

As shown, the device 12 comprises an inverted Cee-shaped segment 30. The Cee-shaped segment 30 includes first, second and third legs 31, 32 and 33, each of rectangular cross section. The 31, 32 are cantilevered from the vertical third leg 33. The legs 31, 32 also extend in the same direction, say along arrow 34. Hence their broad surfaces 26 are coextensive of each other. Also, their free ends 35 bias inwardly toward each other as well as toward a Vee-shaped fourth leg 36 also cantilevered from the third leg 33.

Figure 3:
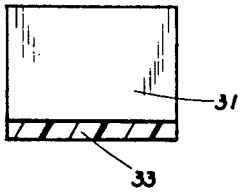
FIG. 3 is a section taken along line 3—3 of FIG. 2 illustrating the Vee-shaped fourth leg in more detail.
Figure 4:
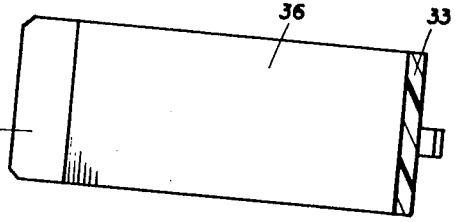
FIG. 4 is a section taken along line 4—4 of FIG. 2 showing the upper leg of the Cee-shaped segment in more detail.

The third leg 33 is thicker than the legs 31, 32 and hence is more rigid than the latter, see FIGS. 3 and 4. The attached end 37 of Vee fourth leg 36 is also seen to be a similar thickness as the third leg 33 at its attachment to the third leg 33 but is uniformly tapered to a smaller thickness as free end 38 is approached. In any event, the attached end 37 is more rigid than the biasable legs 31, 32. Its free end 38 then is folded back at apex 39 and extends back toward the third leg 33. In its relaxed position, the free end 38 is adjacent to the broad surface 26 of the lower leg 32 to provide a passageway 40 that can be biased open to fixedly receive a roof shingle 16' shown in phantom line in FIG. 2 to define the first working position of the device 12.

Figure 6:
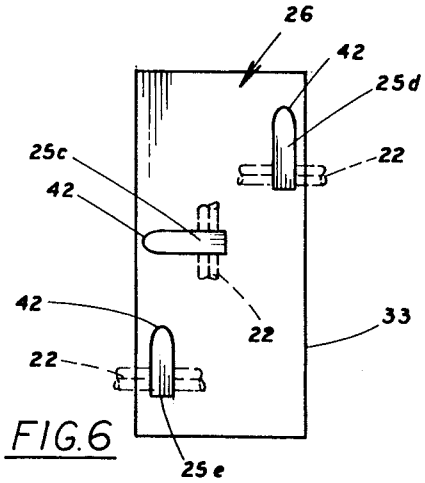
FIGS. 5 and 6 are front and top elevations, respectively, of he Cee-shaped segment of FIG. 2.
Figure 5:
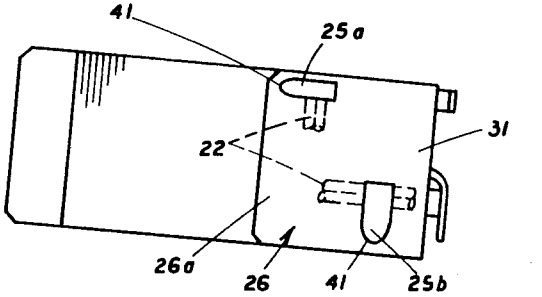

FIGS. 5 and 6 illustrates the orientation of the clips 25 in more detail. As shown, the clips 25 are located on the exposed sides of broad surfaces 26 of the legs 31, 33. In more detail, the clips **25*a*, 25*b* on the surface 26*a* of leg 31 are oriented so that they are open at ends 41 to allow entry of conductors 22 shown in phantom line in either of two directions at right angles to each other. With respect to support leg 33, the clips 25*c*, 25*d* and 25*e* are also open at ends 42 to allow entry of conductors 22 in phantom line at right angles to each other as well as permits parallel location via the clips 25***d* and 25*e*.

Figure 7:
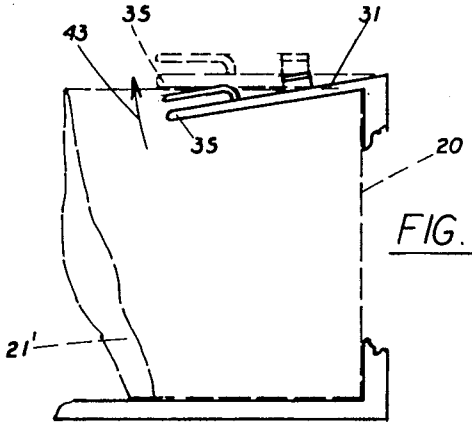
FIG. 7 is a partial side elevations detail of the bracket clamping device of FIG. 2 showing in phantom line how the cantilevered upper leg of the Cee-shaped segment can be opened to receive a roof rafter between it and a more rigid Vee-shaped fourth leg.

Referring again to FIG. 2, note that a second passageway 45 is defined between attached end 37 of the Vee fourth leg 36 and the leg 31 of the inverted Cee-shaped segment 30. Since the leg 31 can be biased in an outward direction as shown in FIG. 7, the second passageway 45 can thus receive end 20' of rafter 21' shown in phantom line thereby to define the second working position of the device 12 in the manner previously described.

Note that the orientation of the first and second working positions in FIGS. 1, 8 and 9 are variable with respect to each other, depending upon the application. In attachment to the roof shingles 16, the bracket device 12 has the following operating characteristics. The leg 32 of the device 12 is captured below one of the shingles 16 while the Vee-leg 36 extends in sliding contact with the upper surface of the shingle 16. Thus the leg 31 of the bracket clamping device 12 extends above the roof 10 by a distance equal to the height of the vertical leg 33 minus the height of the cantilevered Vee-shaped fourth leg 36 above the lower leg 32. But when used in association with deep cupped rain gutter 27, the bracket device 12 connects to the remote lip 28*a* of the gutter 28. In both these applications, the legs 31, 32, 33 and Vee-leg 36 define a common vertical plane. But in the second working position, the legs 31–33 and 36 can be defined by either a horizontal, vertical or off-vertical plane. That is to say, at the end 20 of roof rafter 21, for example, the legs 31–33 and 36 define a common horizontal plane. But when attached to the bottom 28*a* of facia board 28, the legs 31–33 and 36 of the bracket device 12 can be in a vertical plane or if the facia board 28 angles toward the roof ridge, can be in off vertical plane define by the angle of the roof 10. For fence and patio rails that are horizontal, the bracket device of the invention is used wherein the legs 31–33 and 36 lie in a vertical plane with the second opening, of course, being used to capture the fence rail.

In any of the above-described working positions, the invention provides the proper number of clips 25 to attach the electrical conductors 22 of the lights 13 in a variety of directions. Each clip 25 can be biased outwardly from the surface of the legs to capture the lights 13 in a multiplicity of orientations of the electrical conductors 22.

ARTICLE OF MANUFACTURE

Figure 10:
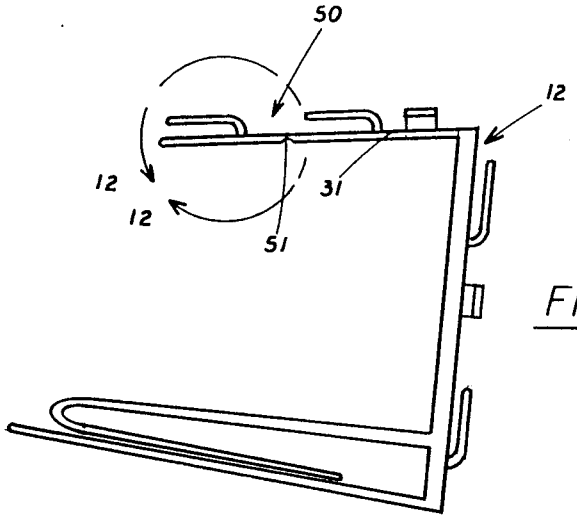
FIGS. 10 and 11 are side and top elevational views of the bracket clamping device of the invention as an article of manufacture showing the addition of a cantilevered end tab integrally attached to the upper leg of the Cee-shaped segment including a detachable means to allow the same to be removed from the upper leg.
Figure 11:
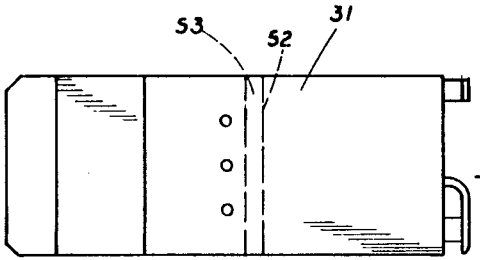
Figure 12:
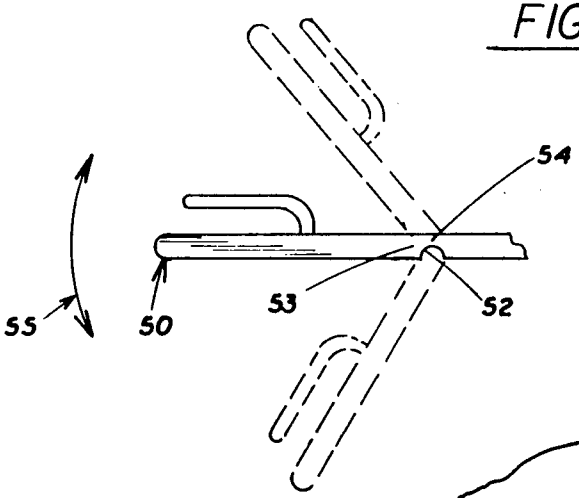
FIG. 12 is a detailed side elevation of the upper leg of the Cee-shaped segment and cantilevered end tab showing phantom line the movement of the end tab to effect removal from the upper leg.

FIGS. 10 and 11 are side and top elevational views of the bracket clamping device 12' modified to provide an article of manufacture. Construction of the device 12' could be via thermoforming using an appropriately shaped mold. But in order to obtain the lowest manufacturing cost per unit output, an injection molding process is preferred. The polymeric resin utilized can be any plastic that is resilient at usual outdoor temperatures such as polypropylene and impact grade polystyrene. But metals such as galvanized sheet or aluminum, could also be used. The result of such processing is shown in FIGS. 10 and 11 wherein the previously described device now includes the addition of a cantilevered end tab 50 integrally attached to the leg 31 of the inverted Cee-shaped segment 30. The cantilevered end tab 50 includes a detachable means 51 to allow the same to be removed from the upper leg 31 via flexing of the latter as shown in FIG. 12. The means 51 comprises a channel 52 (see FIG. 11) that forms a reduced swedged region 53 at its attachment to leg 31. Hence, movement of the end tab 50 in the direction of arrows 55 to remove the former as shown in FIG. 12, is about the axis of rotation 54 concentric of reduced swedged region 53, and continues until the working temperature and stress of the swedged region 53 adjacent to channel 52, is sufficient to allow the separation of the tab 50.

Figure 13:
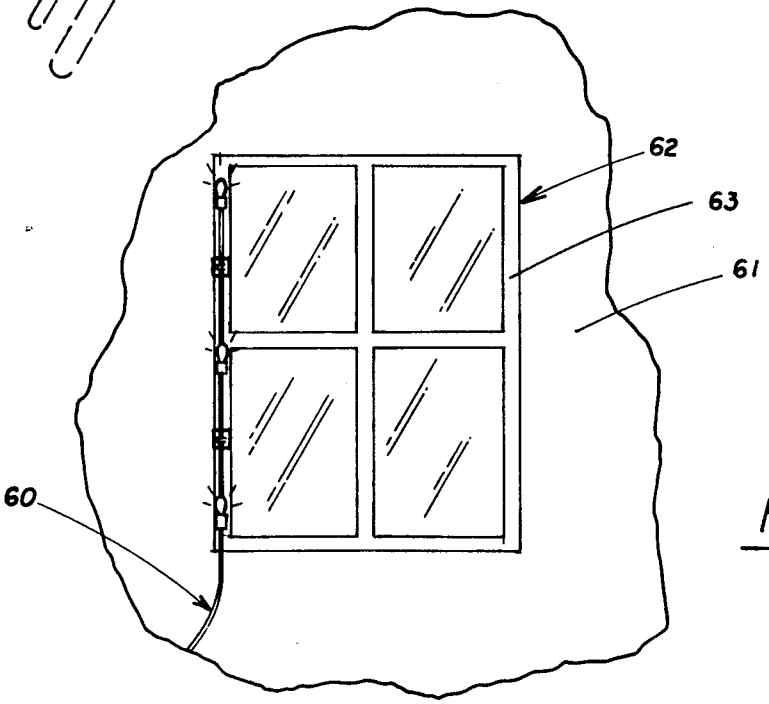
FIG. 13 is a front elevational view of front wall of a house, business or the like showing the removed end tabs of FIG. 12 attached to one side of a window to secure decorative lights therealong.

The tabs 50 can then be used in various locations to support a decorative string of lights 60 as shown in FIG. 13. Note in FIG. 13 that there is shown a front elevational view of front wall 61 of a house, business or the like. Along one side of window frame 63 of window 62 are the series of tabs 50. They secure decorative lights 60.

Figure 14:
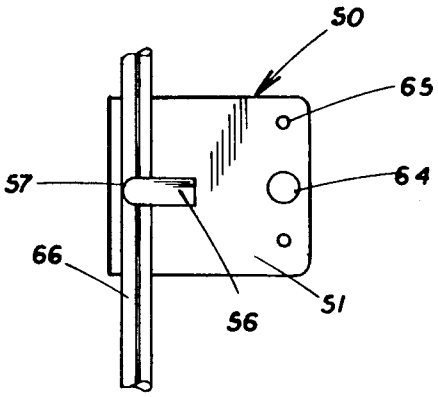
FIG. 14 is a detail of one of the end tabs of FIG. 13 illustrating its attachment to the window frame.

As shown in FIG. 14, the tabs 50 are secured by a brad or push pin 64 extending through one of series of openings 65 through the broad surface 51 of the tab 50. A clip 56 having an open end 57 captures electrical conductors 66 of the lights 60 between it and the broad surface 51 of the tab 50.

Other alterations and modifications of the present invention will become obvious to those of ordinary skill in the art upon of this disclosure, and it is intended that the invention only be limited by the broadest interpretation of the appended claims to which the inventor may be legally entitled.

What is claimed is:

1. A biasable bracket device for a string of lights for use in a multiple number of places about a house, business building or the like, including eaves of a roof having both shingles and rafters of rectangular cross section, shingled roof ridges, facia boards, rain gutters, supports of rectangular cross section of fences, patios and the like, comprising:

an inverted Cee-shaped central segment including first, second and third legs, said first and second legs extending cantilever style from said third leg in one direction from said third leg and having free ends biased inwardly toward each other, said first and third legs having clips to receive electrical conductors of a string of decorative lights to hold said string captive between said clips and said legs, a Vee-shaped fourth leg extending from said third leg having an attached end more rigid than said first and second legs and having a free end folded back toward said third leg and positioned adjacent to said second leg to provide a passageway that can be biased open to fixedly receive one of a shingle of one of said eave shingle and said roof ridge shingle, and a lip of a rain gutter to define a first working position, said attached end also defining a second opening with respect to said first leg that can biasing receive one of facia board, a rafter end and a fence support of rectangular cross section to define a second working position, whereby flexibility of operation to capture and display said string of lights in a plurality of different locations is attained, said clips being integrally attached to broad surfaces of said first and third legs, said clips also being at least two in number per leg surface and oriented at different directions relative to each other to accommodate entry of multi-directional electrical conductors of said string of lights.

2. The bracket device of claim 1 in which said at least two clips have openings that are normal to each other.

3. The bracket device of claim 1 in which said clips integrally attached to said third leg are three in number to accommodate said entry of said electrical conductors.

4. Article of manufacture that includes a biasable bracket device and detachable tab means for a string of lights for use in a number of places about a house, business building or the like, comprising:

an inverted Cee-shaped central segment including first, second and third legs, said first and second legs extending cantilever style from said third leg in one direction from said third leg and having free ends biased inwardly toward each other, said first and third legs having clips to receive electrical conductors of a string of decorative lights to hold said string captive between said clips and said legs, at least one of said first and third legs having an end integrally attached to a tab of similar dimensions as said at least one leg except for length, said tab having at least one clip attached to a broad surface thereof whereby when detached from said at least one leg, said tab can be attached to a frame to receive electrical conductors between said clip and said surface of said tab, a Vee-shaped fourth leg extending from said third leg having an attached end and a free end folded back toward said third leg, said free end being positioned adjacent to said second leg to provide a passageway that can be biased open to fixedly receive fixture of moderate dimension to define a first working position, said attached end also defining a second opening with respect to said first leg that can biasing receive fixtures of larger dimension than said first passageway in define a second working position, whereby flexibility of operation to capture and display said string of lights in a plurality of different locations is attained.

5. The article of manufacture of claim 4 in which said tab integrally attached to said at least one leg includes detachable means, said detachable means including a reduced swedged region that is severable by rotation about an axis of rotation within said swedged region.

6. A biasable bracket device for a string of lights for use in association with a multiple number of fixtures about a house, business building or the like, comprising:

an inverted Cee-shaped central segment including first, second and third legs, said first and second legs extending cantilever style from said third leg in one direction from said third leg and having free ends biased inwardly toward each other, said first and third legs having clips to receive electrical conductors of a string of decorative lights to hold said string captive between said clips and said legs, a Vee-shaped fourth leg extending from said third leg having an attached segment and a free segment folded back toward said third leg, said free segment being positioned adjacent to said second leg to provide a first passageway that can be biased open to fixedly receive first fixtures of moderate dimension to define a first working position, said attached end also defining a second passageway with respect to said first leg that can biasing receive second fixtures of larger dimension than said first passageway in define a second working position, said first and second passageways being positioned in non-intersecting relationship with respect to each other and each being individually and separately operational in a bi-pressure manner to receive said first and second fixtures whereby flexibility of operation to capture and display said string of lights in association with a plurality of different fixtures is attained.

7. The bracket device of claim 6 in which said first and second working positions complementary but separately occur.

8. The bracket device of claim 6 in which said first, second and third legs of said Cee-shaped central segment resembles an inverted block Cee in cross section.

9. The bracket device of claim 8 wherein said first and second passageways are each block Cee-shaped in cross section, positioned side-by-side relative to said Vee-shaped fourth leg, and easily biased to an open position to receive said first and second fixtures without deformation.

10. The bracket device of claim 6 in which said attached segment of said Vee-shaped fourth leg extending from said third leg defines a variable thickness t, and is attached to said free segment by an apex formed between said attached and free segments to permit direction reversal of said fourth leg.

11. The bracket device of claim 10 in which said thickness t of said attached segment of said Vee-shaped fourth leg uniformly decreases as a function of distance from said third leg toward said apex.

12. The bracket device of claim 11 in which thickness t of said attached segment adjacent to attachment to said third leg is greater than that of said free segment of said fourth leg as well as said first and second legs wherein bi-biasing pressure increases as a function of penetration as said fixtures are received within one of said first and second passageways.

13. The bracket device of claim 12 wherein the thicknesses of said free segment and said first and said second legs are essentially the same.

* * * * *